US005382179A

United States Patent [19]

Noschese

[11] Patent Number: 5,382,179

[45] Date of Patent: Jan. 17, 1995

[54] ELECTRICAL CONNECTION SYSTEM WITH MOUNTING TRACK

[75] Inventor: Rocco J. Noschese, Wilton, Conn.

[73] Assignee: Burndy Corporation, Norwalk, Conn.

[21] Appl. No.: 106,130

[22] Filed: Aug. 12, 1993

[51] Int. Cl.[6] ..... H01R 13/627

[52] U.S. Cl. ..... 439/533; 439/369

[58] Field of Search ..... 439/533, 355, 571, 532, 439/298, 369

[56] References Cited

U.S. PATENT DOCUMENTS

| | | | |
|---|---|---|---|
| 3,576,520 | 4/1971 | Stauffer | 439/716 |
| 3,803,533 | 4/1974 | Taplin | 439/571 |
| 4,032,209 | 6/1977 | Rutkowski | 439/355 |
| 4,090,764 | 5/1978 | Malsby et al. | 439/716 |
| 4,157,858 | 6/1979 | Debaigt | 439/716 |
| 4,370,013 | 1/1983 | Niitsu et al. | 439/352 |
| 4,781,612 | 11/1988 | Thrush | 439/62 |
| 4,787,860 | 11/1988 | Bender | 439/358 |
| 4,946,404 | 8/1990 | Takenouchi et al. | 439/352 |
| 4,993,967 | 2/1991 | Matsumoto | 439/489 |
| 5,015,199 | 5/1991 | Hirano et al. | 439/353 |
| 5,184,961 | 2/1993 | Ramirez et al. | 439/532 |

*Primary Examiner*—Gary F. Paumen

*Attorney, Agent, or Firm*—Perman & Green

[57] ABSTRACT

An electrical connection system is provided with two electrical connectors and a mounting track. The mounting track is adapted to be connected to a frame. The connectors are slidingly mounted onto the mounting track and into electrical connection with each other.

15 Claims, 3 Drawing Sheets

ELECTRICAL CONNECTION SYSTEM WITH MOUNTING TRACK

BACKGROUND OF THE INVENTION

1. Field of the Invention

The present invention relates to electrical connectors and, more particularly, to a system for connecting electrical connectors to each other on a mounting track.

2. Prior Art

U.S. Pat. Nos. 3,576,520 and 4,090,764 disclose mounting of electrical connectors to mounting tracks or channels. U.S. Pat. No. 4,157,858 discloses a support section bar for supporting a terminal block. The following U.S. Patents disclose various different systems for connecting electrical connectors to each other: U.S. Pat. Nos. 4,993,967; 5,015,199; 4,370,013; 4,787,860; and 4,946,404.

SUMMARY OF THE INVENTION

In accordance with one embodiment of the present invention an electrical connection system is provided comprising a mounting track, a first electrical connector, and a second electrical connector. The mounting track has means for connecting the track to a frame. The first electrical connector has means for directly mechanically connecting to the mounting track. The second electrical connector has means for directly mechanically connecting to the mounting track and, directly electrically connecting to the first electrical connector. The system allows the first and second electrical connectors to be physically connected to the frame through the mounting track such that movement of the connectors relative to the frame can be restrained.

In accordance with another embodiment of the present invention an electrical connection system is provided comprising a mounting track and a first electrical connector. The mounting track is connected to a frame. The first electrical connector is mechanically connected on the mounting track. The mounting track also includes means for mechanically connecting a second electrical connector thereon such that the second electrical connector mechanically and electrically connects with the first electrical connector.

In accordance with another embodiment of the present invention in an electrical connection system for connecting a first electrical connector to a second electrical connector an improvement is provided comprising a mounting track. The mounting track has means for mechanically independently connecting the connectors on the track and means for mechanically connecting the track to a frame. The connectors are mechanically connected to the frame by the mounting track thereby preventing unintentional movement of the connectors relative to the frame, and connection of the first and second connectors onto the track electrically connects the connectors to each other.

BRIEF DESCRIPTION OF THE DRAWINGS

The foregoing aspects and other features of the invention are explained in the following description, taken connection with the accompanying drawings, wherein.

DETAILED DESCRIPTION OF THE INVENTION

Figure 1:
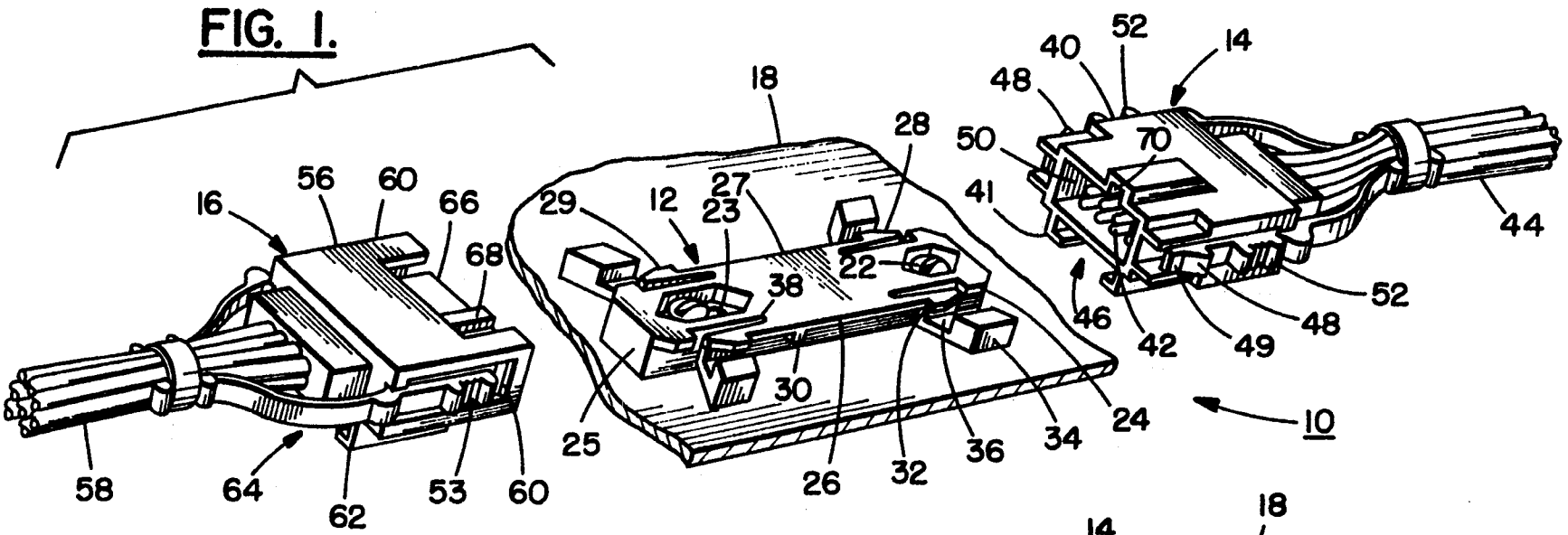
FIG. 1 is an exploded perspective view of an electrical connection system incorporating features of the present invention.

Referring to FIG. 1, there is shown an electrical connection system 10 incorporating features of the present invention. Although the present invention will be described with reference to the embodiments shown in the drawings, it should be understood that the present invention may be embodied in various different types of embodiments. In addition, any suitable size, shape or type of elements or materials could be used.

Figure 3:
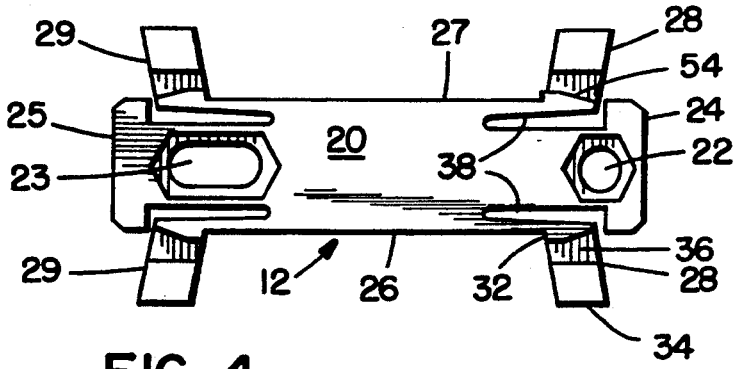
FIG. 3 is a plan top view of the mounting track shown in FIG. 1.

The system 10 generally comprises a mounting track 12, a first electrical connector 14, and a second electrical connector 16. Referring also to FIG. 3 the mounting track 12 can be comprised of any suitable material, such as metal or plastic. The track 12 is designed to be fixedly stationarily connected to a frame 18, such as a frame of an aircraft. The track 12 includes a center elongate section 20, two mounting holes 22, 23 at opposite ends 24, 25 of the center section 20, two side rails 26, 27, and pairs of snap-locks 28, 29 at the opposite ends 24, 25. The track 12 is fastened to the frame 18 by screws in holes 22, 23 shown in FIG. 1, but any suitable means could be used. The two side rails 26, 27 are incorporated into part of the snap-locks 28, 29. Stops 30 are provided on the bottom of each rail proximate the center of the track. The snap-locks 28, 29 are substantially minor images of each other.

Each end 24, 25 has its own pair of snap-locks; one on each side. The snap-locks include a deflectable cantilevered latch 32, a release section 34, and a channel 36. The latch 32 extends laterally past the side rails 26, 27. The channel 36 is located between the latch 32 and the release section 34. The release section 34 is located laterally outward from the latch 32. A slot 38 is provided inward of the latch 32 such that a user can push inward on the release section 34 to resiliently deflect the latch 32 inward. In alternate embodiments, other types of latching or locking systems to mount the connectors 14, 16 on the track 12 could be provided. In another alternate embodiment, the track 12 could comprise a plurality of spaced side rails and snap-locks aligned in a row for allowing multiple pairs of connectors to be connected parallel to each other on the track. The side rails could also be angled, such as for connectors that mate at a right angle to each other.

Figure 2:
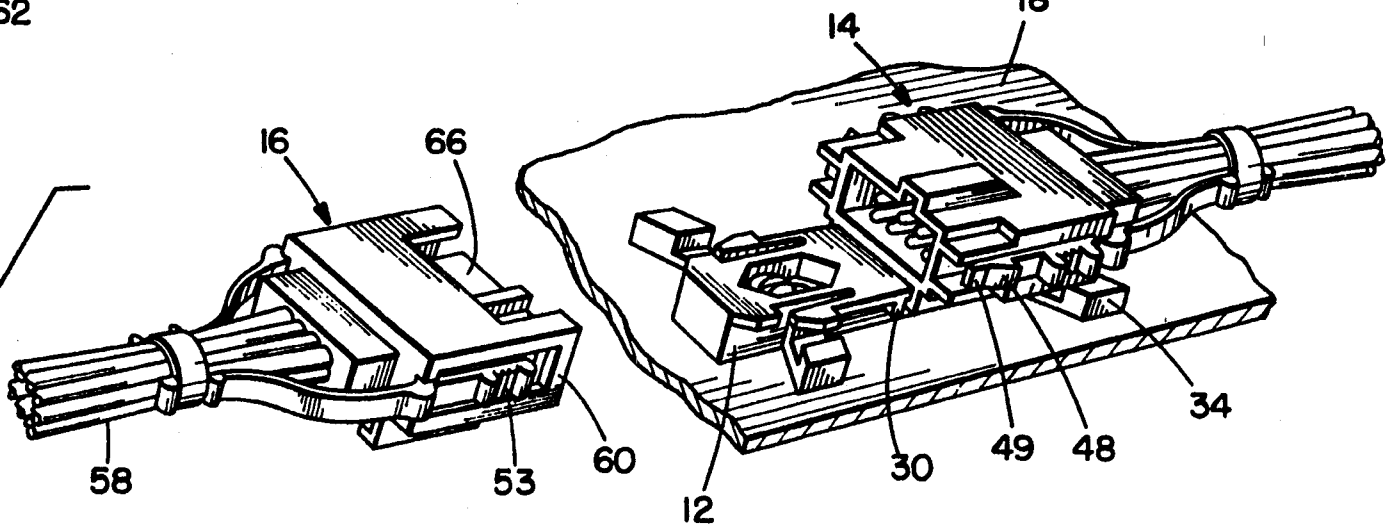
FIG. 2 is a perspective view of the system shown in FIG. 1 showing one of the electrical connectors mechanically connected to the mounting track.
Figure 4:
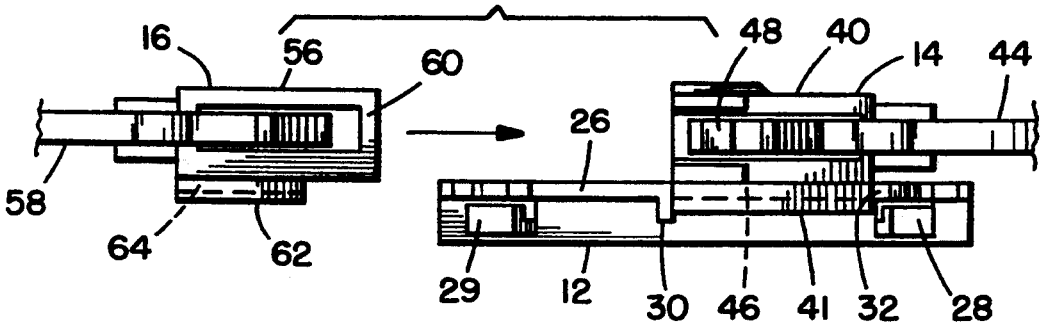
FIG. 4 is a plan side view of the system shown in FIG. 2.

The first connector 14 generally comprises a housing 40 and electrical contacts 42. Conductors 44 are electrically connected to the contacts 42 and exit the rear of the housing 40. The housing 40 includes a bottom section 41 with a side rail channel 46, deflectable latches 48 at its sides, and a receiving area 50. The contacts 42 are located in the receiving area 50. The side latches 48 are adapted to directly fixedly connect the first connector 14 to the second connector 16. The side latches 48 are cantilever deflectable and have a finger section 52 that allows a user to press the latches inward to allow the first and second electrical connectors to be disconnected from each other. The bottom section 41 is suitably sized and shaped to be slidingly mounted on the track 12 at its first end 24 capturing portions of the track side rails 26, 27 in the channel 46. The length of the bottom section 41 is about the same as the distance between the stop 30 and the front of the latch 32 on the track 12. Thus, as illustrated in FIGS. 2 and 4, the first connector 14 can be connected to the track 12 with the side rails 26, 27 in the channel 46 and the housing bottom section 41 being captured between the stop 30 and the front of the latches 32. More specifically, due to the interlocking nature of the housing bottom section 41 on the track 12 (due to side rails 26, 27 being received in channel 46) and the presence of the stop 30 and latch 32 in front of and behind the bottom section 41, the first connector 14 can be fixedly stationarily mounted to the track 12. As the housing 40 is slid onto the rails 26, 27 the front of the housing 40 contacts the ramps 54 on the latches 32 and pushes the latches inward so the bottom of the housing can pass the latches. When the housing 40 reaches its final mounted position, the latches snap back into position behind the bottom section 41. To remove the first connector 14 from the track 12 a user merely presses inward on the two release sections 34. This deflects the latches 32 inward moving the latches 32 out of the reward path of the bottom section 41. The user then merely pulls the housing 40 reward to slide the first connector 14 off of the track 12.

The second connector 16 generally comprises a housing 56 and electrical contacts (not shown). Conductors 58 are electrically connected to its contacts and exit the rear of the housing 56. The housing 56 includes side latch hooks 60, a bottom section 62 with a side rail channel 64, and a front plug section 66. The second connector contacts (not shown) are located in the front plug section 66. The front plug section 66 is suitably sized and shaped to be matingly received in the receiving area 50 of the first connector 14. The plug section 66 has an integral registration key 68 on its top. This registration key 68 is adapted to be received in key receiving area 70 of the first connector housing 40. The key 68 and area 70 must be mating or the two connectors will not be able to connect to each other. Thus, the key 68 and area 70 prevent connection of the connectors 14, 16 to non-mating connectors. When the plug section 66 is inserted into the receiving area 50, the electrical contacts for the two connectors make electrical connection each other.

The bottom section 62 and channel 64 are substantially the same as the bottom section 41 and channel 46 on the first connector 14 except, in the embodiment shown, the length of the bottom section 62 is shorter than the length of the bottom section 41. The bottom section 62 is suitably sized and shaped to be slidingly mounted on the track 12 at its second end 25 capturing portions of the track side rails 26, 27 in the channel 64. The length of the bottom section 62 is about the same as the distance between the stop 30 and the front of the latches 32 on the second end 26 of the track. Thus, the second connector 16 can be connected to the track 12 with the side rails 26, 27 in the channel 64 and the housing bottom section 62 being captured between the stop 30 and the front of the latches 32. The functioning of the latches 32 of the snap-locks 29 for locking and unlocking the second connector 16 to the track 12 is essentially the same as the functioning of the latches 32 of the snap-locks 28 for locking and unlocking the first connector 14 to the track. Therefore, the description will not be repeated.

The side latch hooks 60 are adapted to receive portions of the latches 48 on the first connector 14. The latch hooks 60 and latches 48 function as snap-locks. When the two connectors are connected to each other the latches 48 snap behind the hooks 60 to prevent the connectors 14, 16 from being inadvertently disconnected. However, the user can press the finger sections 52 to disconnect the latches 48 from the hooks 60 to allow the two connectors to be intentionally disconnected from each other. The dual locking system of the connectors to each other (by means of latches 48 and hooks 60) and the individual connectors with the track 12 (by means of snap-locks 28, 29), provides an extremely strong, secure and safe connection to insure that the two connectors 14, 16 will not be inadvertently disconnected from each other. In addition, the connectors 14, 16 could also be used without the track 12, due to their independent locking to each other, if so desired. In the embodiment shown, the finger sections 52 on the first connector 14 are aligned with the release sections 34 of the first snap-locks 28 when the connector 14 is mounted on the track 12. Therefore, the user can depress aligned finger sections and release sections at the first end 24 to unlock both the connection to the first connector 14 to the track 12 and the connection of the first connector 14 to the second connector 16 at the same time. Likewise, the second connector 16 has finger sections 53 that are aligned with the release sections 34 of the second snap-locks 29 when the connector 16 is mounted on the track 12. The finger sections 53 are inwardly deflectable and are adapted to contact the front portion 49 of latches 48. When the finger sections 53 are depressed, they can move the latches 48 out of engagement wit the hooks 60. Therefore, the user can depress aligned finger sections and release sections at the second end 25 to unlock both the connection of the second connector 16 to the first connector 14 and the connection of the second connector 16 to the track 12 at the same time.

Figure 5:
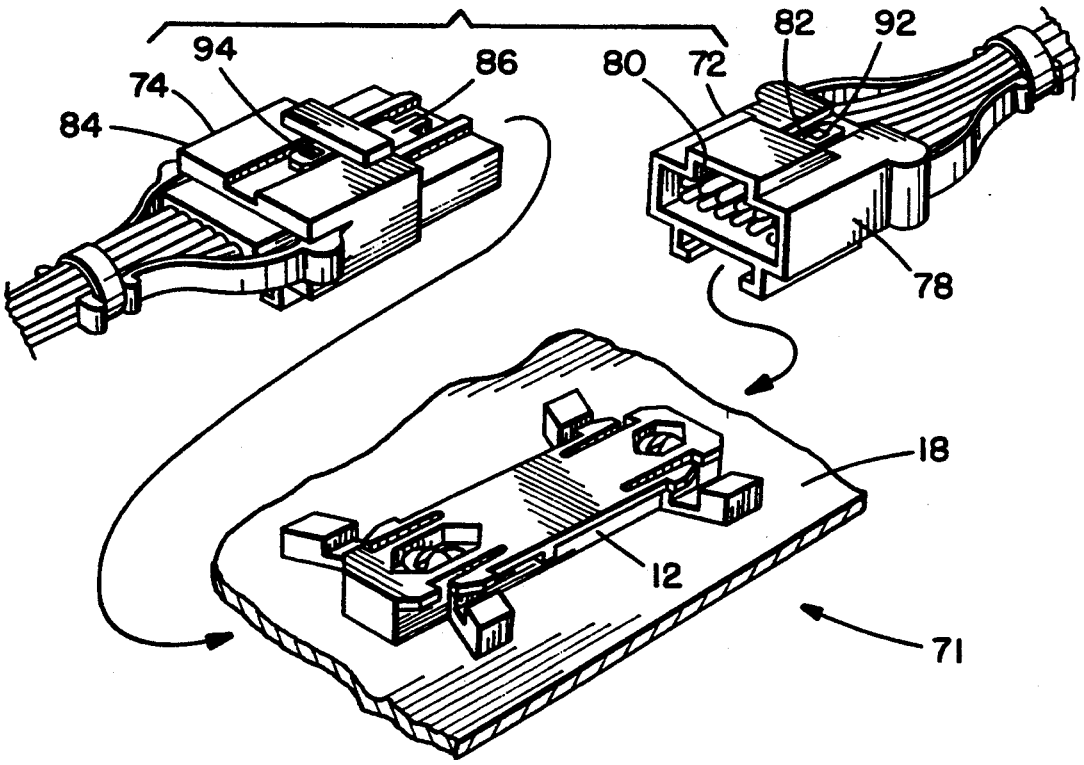
FIG. 5 is an exploded perspective view of an alternate embodiment of the present invention.
Figure 6:
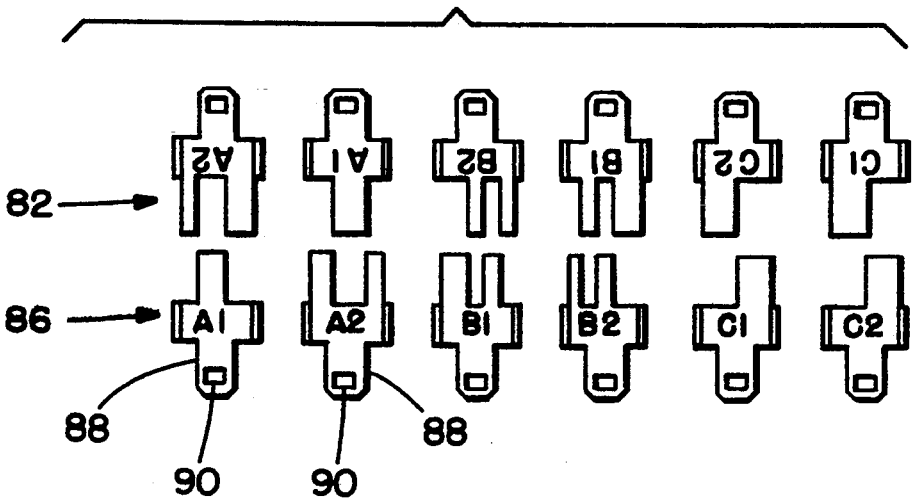
FIG. 6 is a plan top view of registration keys used in the system shown in FIG. 5.

Referring now to FIG. 5, there is shown a perspective view of an alternate embodiment of the present invention. In the embodiment shown, the system 71 has the track 12, a first electrical connector 72 and a second electrical connector 74. The first electrical connector 72 is essentially similar to the first connector 14 shown in FIG. 1 with two exceptions. First, the housing 78 does not have the latches 48. Second, rather then key receiving area 70, the housing 78 has a receiving area 80 with a registration key 82 located therein. The second electrical connector 74 is also essentially similar to the second connector 16 shown in FIG. 1 with two exceptions. First, the housing 84 does not have the latch hooks 60. Second, rather than integral key 68, the housing 84 has a registration key 86 connected thereto. FIG. 6 shows a plan top view of three pairs of key A1, A2; B1, B2; C1, C2; that can be used as the keys 82, 86. The keys can be arranged as shown to provide six key registration patterns. Each key has a stem 88 with a hole 90. The housings 78 and 84 have posts 92, 94. The stems 88 are able to snap-lock connect to the posts 92, 94 to fixedly connect the registration keys to the housings. In alternate embodiments, other suitable means could be used to connect the registration keys to the housings, or for preventing inadvertent accidental connection of connectors to each other that were not intended to be connected to each other.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connection system comprising:

a mounting track having side rails and means for connecting the track to a frame;

a first electrical connector having means for directly mechanically connecting to the mounting track; and a second electrical connector having means for directly mechanically connecting to the mounting track and, directly electrically connecting to the first electrical connector wherein the system allows the first and second electrical connectors to be physically connected to the frame through the mounting track such that movement of the connectors relative to the frame can be restrained, wherein the first and second connectors each have a side rail channel which receive the side rails such that the first and second connectors can be slidingly mounted onto the mounting track.

2. A system as in claim 1 wherein the mounting track has snap-locks for fixedly connecting the first and second connectors on the mounting track.

3. A system as in claim 1 wherein the mounting track has a stop along the side rails for positioning the first and second connectors at predetermined locations on the mounting track.

4. A system as in claim 1 wherein the mounting track includes means for independently mounting the first and second connectors thereon at predetermined locations.

5. A system as in claim 4 wherein the mounting track includes means for independently removing the first and second connectors from the mounting track.

6. A system as in claim 1 wherein the first and second connectors include keying sections that prevent the first connector from being connected to the second connector unless their keying sections matingly engage each other.

7. A system as in claim 1 wherein the first and second connectors include latching sections that allow the connectors to be directly mechanically latched to each other.

8. A system as in claim 6 wherein the keying sections include polarizing keys connected to housings of the connectors.

9. An electrical connection system comprising:

a mounting track connected to a frame; and a first electrical connector removably mechanically connected on the mounting track along mounting rails of the mounting track, wherein the mounting track has means for mechanically connecting a second electrical connector thereon such that the second electrical connector mechanically and electrically connects with the first electrical connector, wherein the means for mechanically connecting the second electrical connector to the mounting track includes the mounting rails extending past the first electrical connector such that the second electrical connector can be slidingly mounted on the rails to thereby allow the second connector to be slid into connection with the first connector.

10. A system as in claim 9 wherein the first electrical connector is slidingly mounted along the mounting rails and the mounting track has a stop to stop the sliding mounting of the first electrical connector at a predetermined location on the mounting track.

11. A system as in claim 9 wherein the mounting track has snap-locks for fixedly mounting the first and second connectors on the mounting rails.

12. In an electrical connection system for connecting a first electrical connector to a second electrical connector, the improvement comprising:

a mounting track having means for mechanically independently connecting the connectors on the track and means for mechanically connecting the track to a frame, wherein the connectors are mechanically connected to the frame by the mounting track thereby preventing unintentional movement of the connectors relative to the frame, connection of the first and second connectors onto the track electrically connects the connectors to each other, the means for mechanically connecting the connectors on the track has a rail which the first and second connectors are slidingly mounted on, and the rail is straight and allows the first and second connectors to be mounted on opposite ends of the rail and slid towards each other into electrical connection with each other.

13. A system as in claim 12 wherein the means for mechanically connecting the connectors on the track includes snap-locks for fixedly but removably connecting the connectors on the track.

14. A system as recited in claim 12 wherein the means for mechanically connecting the connectors on the track includes means for locking the connectors at predetermined locations on the track.

15. An electrical connection system comprising:

means for matingly connecting two electrical connectors to each other including snap-locks for directly mechanically attaching the connectors to each other; and means for mechanically connecting the connectors to a frame comprising a mounting track having means for independently connecting each of the connectors to the track, the track being adapted to slidingly receive the connectors thereon into mating engagement with each other along coaxial paths on the track.

* * * * *